US005275190A

United States Patent [19]

Williams

[11] Patent Number: 5,275,190

[45] Date of Patent: Jan. 4, 1994

[54] FAUCET HAVING AN EASILY INSTALLABLE SPOUT

[76] Inventor: Richard T. Williams, P.O. Box 39, Uwchland, Chester County, Pa. 19480

[21] Appl. No.: 909,701

[22] Filed: Jul. 7, 1992

[51] Int. Cl.[5] ..... F16K 21/00

[52] U.S. Cl. ..... 137/15; 137/801; 285/332.3

[58] Field of Search ..... 137/801, 615, 15; 285/332.3

[56] References Cited

U.S. PATENT DOCUMENTS

| | | | |
|---|---|---|---|
| 2,083,228 | 6/1937 | Geyer | 285/332.3 |
| 2,570,635 | 10/1951 | Beyer, Jr. | 137/801 X |
| 2,946,606 | 7/1960 | Smith | 285/332.3 |
| 3,080,183 | 3/1963 | Luertzing et al. | 285/332.3 X |
| 3,476,413 | 11/1969 | Coberly et al. | 285/332.3 |
| 4,037,624 | 7/1977 | Turner | 137/801 X |
| 4,456,287 | 6/1984 | Bisonaya | 137/801 X |
| 4,592,388 | 6/1986 | Wilcox | 137/801 X |
| 4,976,287 | 12/1990 | Sheen | 137/801 |
| 4,997,008 | 3/1991 | Zbin | 137/801 |
| 5,127,427 | 7/1992 | Kajpust et al. | 137/801 X |

*Primary Examiner*—John Rivell

*Attorney, Agent, or Firm*—John F. A. Earley; John F. A. Earley, III

[57] ABSTRACT

A faucet comprises a base, a spout having a first free end portion for emitting fluid and a second end portion for insertion into a hole of the base, and a sealing and locking device formed at the second end portion. The sealing and locking device includes a tapered portion at the second end portion of the spout, the tapered portion having a tapered outer diameter that decreases toward the second end portion of the spout. The sealing and locking device may further include a groove formed in the spout at the second end portion, and an O-ring adapted to be seated in the groove. Alternatively, the sealing and locking device includes a groove formed in a spout, the groove having a tapered portion with a tapered outer diameter that increases toward the second end portion of the spout, and an O-ring adapted to be seated in the groove. In the alternative embodiment, the exterior surface of the spout at its second end portion, except at the tapered groove, may be straight and untapered.

11 Claims, 3 Drawing Sheets

FAUCET HAVING AN EASILY INSTALLABLE SPOUT

BACKGROUND OF THE INVENTION

1. Field of the invention

This invention relates to faucets, and more particularly concerns faucets having inexpensive, strong and reliable spouts, and the installation of such spouts into faucets.

2. Description of the Prior Art which are secured into the threaded bore of a faucet base. Use of such threaded spouts presents certain problems.

First, it tends to be expensive to single point or otherwise thread the spout base as may be required, and similarly it is expensive and sometimes difficult to properly thread brass spouts; particularly thin walled brass spouts.

Second, the conventional threaded spouts require a fairly deep 0-ring groove, which weakens the spout at a point where greatest strength is required, and this may lead to problems. For example, if a saucepan is accidentally swung into such a spout, an impact load is placed on the spout. The stress point on the spout is where the spout enters the body of the faucet base, and this is where the spout is thinnest and weakest. Accordingly, such an impact many times causes spouts to break off the faucet, necessitating that the threaded portion of the spout be dug out of the faucet body to permit a new spout to be installed.

Thickening the walls of the spout in an effort to strengthen the spout is undesirable due to the extra expense for more metal to thicken the walls.

SUMMARY OF THE INVENTION

It is an object of this invention to provide a faucet and a spout for use in such a faucet, the spout being inexpensive, strong, and reliable and being without the above disadvantages of the prior art threaded spouts.

These and other objects are accomplished by providing the faucet and spout of this invention.

The faucet comprises a base having exterior surfaces and inner wall surfaces, a hole defined by the inner wall surfaces of the base and formed in one of the exterior surfaces, spout means for transporting fluid, the spout means having a first free end portion for emitting the fluid and a second end portion that is adapted for insertion into the hole of the base, sealing and locking means formed at the second end portion of the spout means for sealing and locking the spout to the base, the sealing and locking means including a tapered portion at the second end portion of the spout means, the tapered portion having a tapered outer diameter that decreases toward the second end portion of the spout means, the spout means being sealed and locked to the base through tight surface-to-surface contact between the inner wall surfaces of the base and the tapered portion of the spout outer surface.

The sealing and locking means may further include a groove formed in the outside surface of the spout means at the second end portion, and an O-ring adapted to be seated in the groove.

Alternatively, the sealing and locking means includes a groove, formed in the outside surface of the second end portion of the spout means, that has a tapered portion, having a tapered outer diameter that increases toward the second end portion of the spout means, and an O-ring seated in the groove. The spout means is sealed and locked to the base by permitting fluid pressure to push the spout upwardly slightly causing downward positioning of the O-ring in said groove to compress the O-ring tightly against the inner wall surfaces of the base.

The spout of the invention does not require any threaded portions for installation. The spout is amazingly simple to install, and yet hard to pull out of the faucet base after installation. The faucet and spout of the invention may employ plastic and/or metal parts.

DETAILED DESCRIPTION OF THE DRAWINGS

Figure 1:
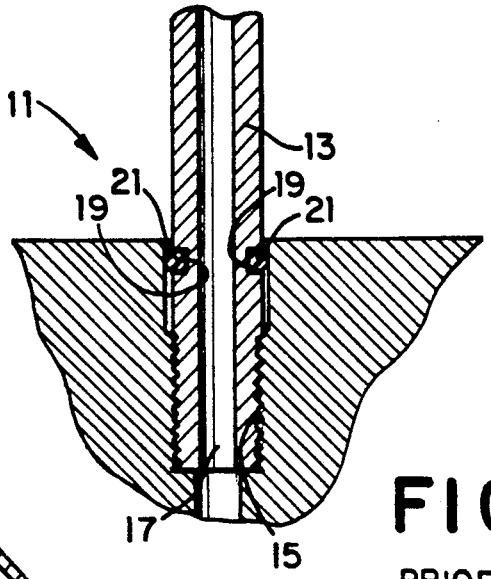
FIG. 1 PRIOR ART
FIG. 1 is a partial view in cross-section of a conventional faucet installation.

Turning now to the drawings, FIG. 1 shows a conventional faucet 11, wherein a straight spout 13 has an outside threaded end portion 15 for threading the spout 13 into the inside of threaded bore 17 of faucet 11. The spout 13 has a deep circumferential groove 19 formed therein, in which an O-ring 21 is seated.

A disadvantage of this conventional faucet 11 is that thin section 21 is created by deep groove 19 at a point in the spout 13 where the greatest strength is required. Thus, if this conventional faucet 11 were installed on a sink ledge, and someone swung a saucepan into it, a very high load would be imparted to the spout 13 at the thin section 21 where the spout 13 is weakest. Therefore, the conventional spout 13 may break or bend at the thin section 21, leaving broken sections of the spout 13 embedded in the and portion 15 of faucet 11.

Figure 2:
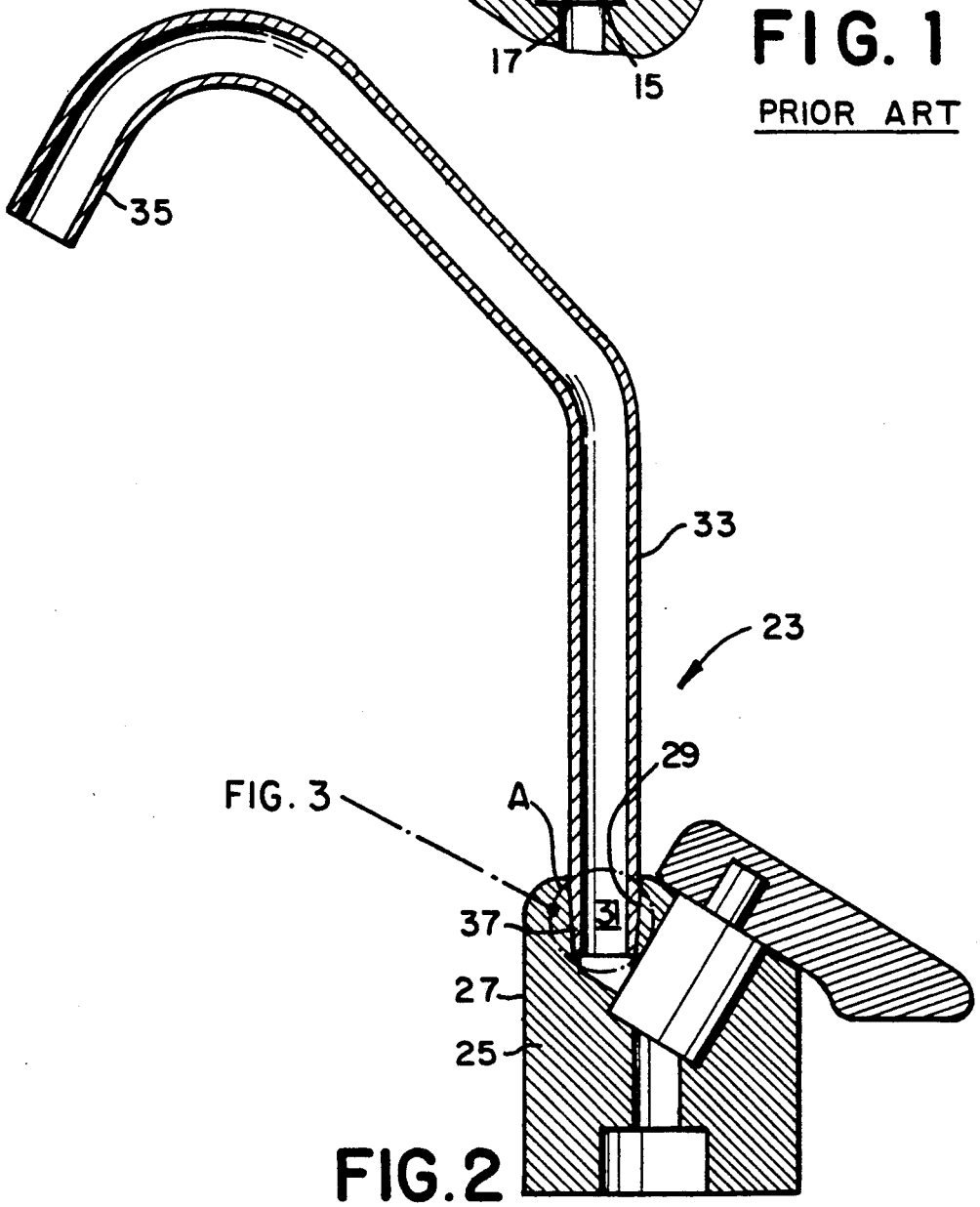
FIG. 2 is a view in cross-section of a faucet having a tapered spout constructed in accordance with the invention.
Figure 3:
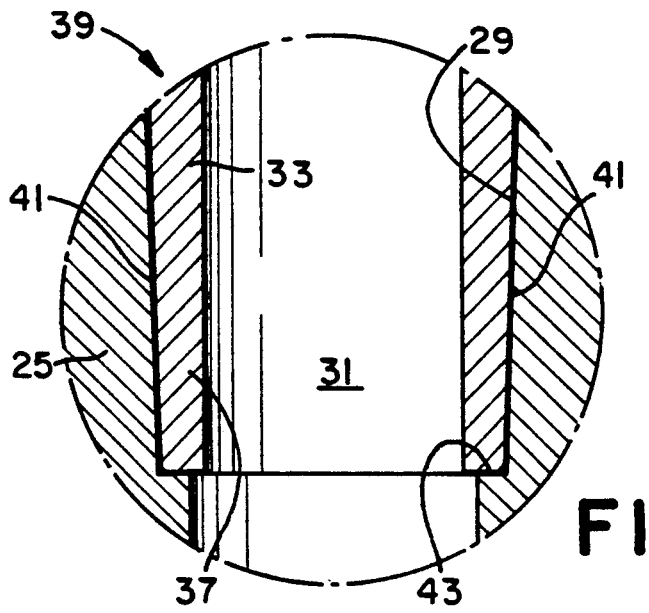
FIG. 3 is an enlarged view in cross-section of the circle A shown in FIG. 2.

Turning now to FIGS. 2 and 3, there is shown a faucet 23 having an inexpensive, strong and reliable construction for transporting fluid constructed in accordance with the invention. The faucet 23 comprises a base 25 having exterior surfaces 27 and inner wall surfaces 29, and a hole 31 in the base 25 which is defined by the inner wall surfaces 29 and is formed in one of the exterior surfaces 27. The faucet 23 includes a spout 33 for transporting fluid, the spout 33 having a first end portion 35 for emitting the fluid, and a second end portion 37 which is adapted for insertion into the hole 31 of the base 25.

The faucet 23 also includes sealing and locking means 39 formed at the second end portion 37 of the spout 33 for sealing and locking the spout 33 to the base 25. The sealing and locking means 39 includes a an inwardly tapered portion 41 of the outer surface of the spout 33 at the second end portion 37. The tapered portion 41 has a smooth, tapered outer diameter that decreases toward the bottom of the second portion 37 of the spout 33. The spout 33 is sealed and locked to the base 25 through tight surface-to-surface contact between the inner wall surfaces 29 of base 25 which are smooth and tapered to match the taper of the outer surface of tapered portion 41, of the second end portion 37 of the spout 33.

The taper of the tapered outer surface of the tapered portion 41 ranges from about ¾ to about 3 degrees with respect to the longitudinal axis of spout 33 at second end portion 37. More preferably, the taper of the tapered outer surface of the tapered portion 41 is 1 degree.

A method of assembling the faucet 23 comprises the steps of pushing the spout 33 into the hole 31 of the base 25, and placing the outer tapered surface of tapered portion 41 of the spout 33 into contact with the inner wall surfaces 29 of the base 25. The spout 33 is then twisted slightly while being pushed until the second end portion 37 of the spout 33 tightly contacts the inner wall surfaces 29 and lower ledge surface 43 of the base 25, thereby sealing and locking the spout 33 to the base 25 s that faucet 23 is ready for use, i.e., transporting fluid such as water.

In use, faucet 23 is opened to permit fluid to flow out of the first end portion 35 of spout 33.

Figure 4:
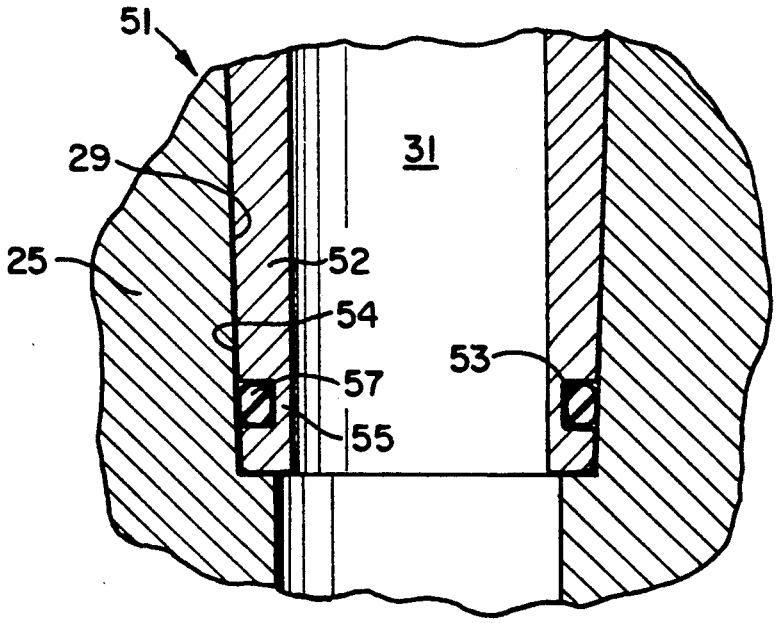
FIG. 4 is a partial view in cross-section of an alternative embodiment of the invention showing a faucet having a tapered spout with a groove formed in the outside surface of the end portion of the spout near its bottom and an O-ring seated in the groove.

A second embodiment of the invention is shown in FIG. 4. Here, a faucet 51 has substantially the same construction as faucet 23, except faucet 51 includes a spout 52 for transporting fluid. Spout 52 includes a groove 53 formed in the outer surface of its tapered portion 54 near the bottom of its second end portion 55, and an O-ring 57 which sits in the groove 53. Preferably, the outer diameter of the outer surface of the O-ring 57 is slightly larger than the diameter of the inner surface of the hole 31 in the base 25, and O-ring 57 is compressed inwardly when spout 52 is placed in base 25. In this embodiment, there is a double sealing effect—a first seal caused by the tight surface-to-surface contact between the smooth, tapered, inner wall surfaces 29 and the smooth matching tapered portion 54 of spout 52, and a second seal caused by O-ring 57 being compressed between spout 51 and inner wall surfaces 29 of these 25.

A method of installing faucet 51 comprises the steps set out above and further comprises the step of placing the O-ring 51 into contact with the inner wall surfaces 29 of the base 25.

Faucet 51 is used in the same manner as faucet 23.

Figures 5, 6:
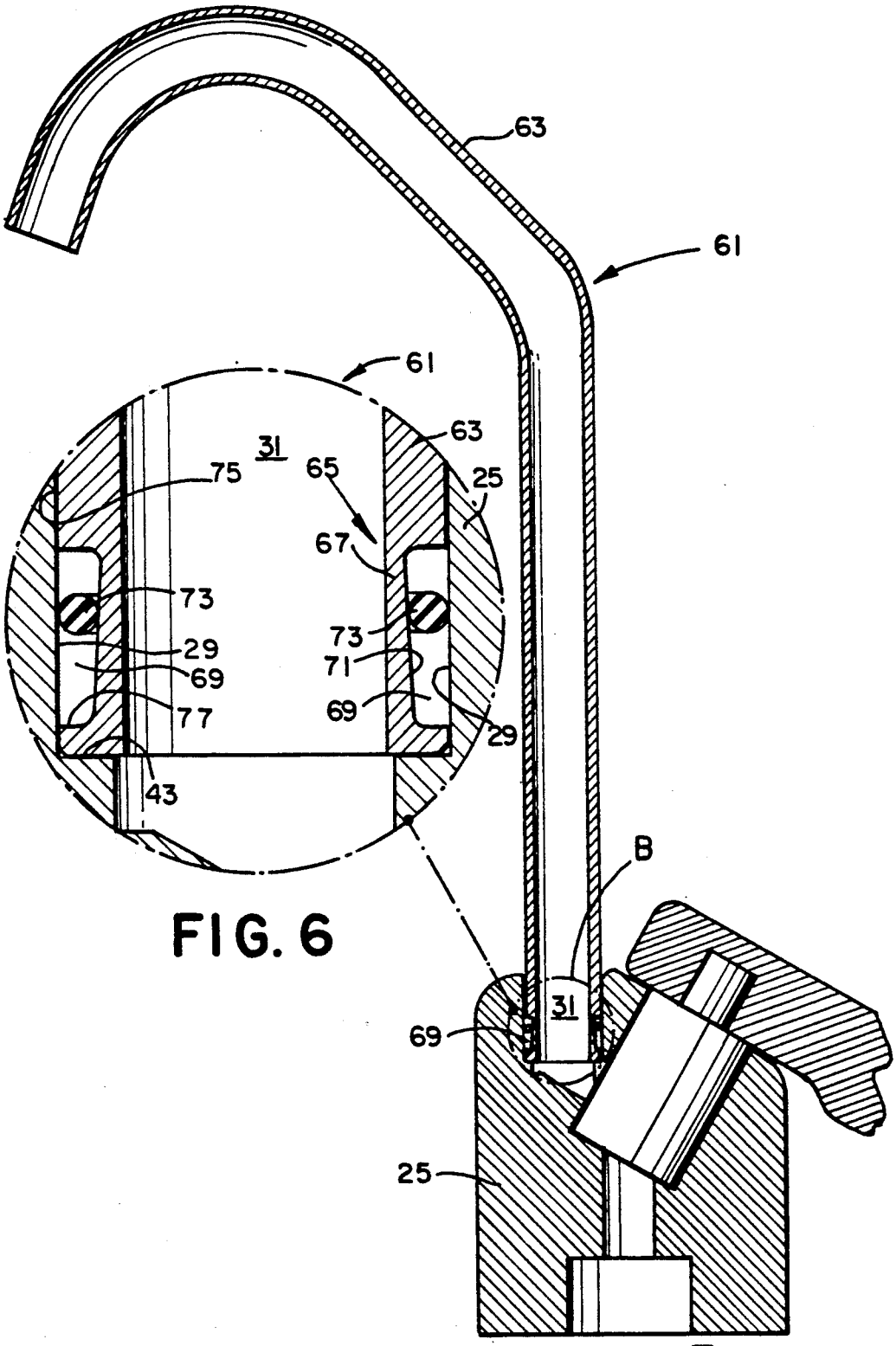
FIG. 5 is a view in cross-section of another alternative embodiment of the invention showing a faucet having a straight, untapered spout with a tapered O-ring groove formed in the outside surface of the end portion of the a spout.
FIG. 6 is an enlarged view in cross-section of the circle B shown in FIG. 5.

A third embodiment of the invention is shown in FIGS. 5 and 6. Here, faucet 61 is substantially the same as faucet 23 of FIG. 2, except faucet 61 includes a different, non-tapering spout 63 for transporting fluid.

Spout 63 includes sealing and locking means 65 formed at the second end portion 67 of the spout 63 for sealing and locking the spout 63 to the base 25. The sealing and locking means 65 includes a groove 69, formed in the spout 63 at the second end portion 67, as shown in FIG. 6. The groove 69 has a tapered portion 71 with a tapered outer surface with a diameter that increases toward the end of the second end portion 67 of the spout 63, and an O-ring 73 that sits in the groove 69. The outer diameter of the O-ring 73 is preferably slightly larger than the inside diameter of the hole 31 in the base 25. When fluid pressure pushes spout 63 upwardly, there is a re-positioning of O-ring 73 with respect to its location in groove 69. In particular, as spout 63 moves upwardly, O-ring 73, which is in contact with inner wall surfaces 29 of the base and spout 63 at groove 69, is positioned in groove 69 closer to the lower end 77 of groove 69 and is compressed more tightly against the inner wall surfaces 29 of the base 25, due to the reduction of space between its lower position in groove 69 and inner wall surfaces 29, to seal and lock spout 63 to base 25.

The tapered outer diameter of the tapered portion 71 is preferably greater than 2 degrees with respect to the inner wall surfaces 29 of the base 25.

The exterior surface 75 of second end portion 67 of spout 63, except at groove 69, is straight and untapered, as shown in FIG. 6, to match the inner wall surfaces 29 of hole 31, which are straight and untapered in this embodiment. Faucet 61 and spout 63 may be made of plastic or metal.

A method of assembling faucet 61 comprises the steps of pushing the spout 63 into the hole 31 of the base 25, O-ring 73 being urged upwardly in the groove 69 due to friction between it and inner wall surfaces 29 as the spout 63 is pushed downwardly into hole 31 in the base 25. When spout 63 is completely inserted into the hole 31, the second end portion 67 of the spout 63 contacts the lower ledge surface 43 of the base 25.

ADVANTAGES

An advantage of the present invention is that the faucet has a strong and inexpensive design, because it eliminates the need for matching threads, and for a deep groove at a critical stress location and the need for a thick spout wall construction. Further, the faucet of the invention is reliable because one need not be concerned about threads which may become calciumed or may not thread or lock properly.

No threading is required to secure the inventive spout to the inventive faucet, and the spout and faucet constructed in accordance with the invention may be made of metal and/or plastic.

Also, the spout may be installed into the hole in the base of the faucet relatively easily, and yet is adequately difficult to pull out. Despite the simple installation of the spout of the invention into the faucet of the invention, the seal of the spout in the base holds anticipated pressures with adequate safety margins.

I claim

1. A faucet for transporting fluid having an inexpensive, strong and reliable construction comprising a base having exterior surfaces and inner wall surfaces, a hole being defined by the inner wall surfaces of the base and being formed in one of the exterior surfaces and having an entrance portion, said hole having a taper in its bottom portion that tapers to a smaller diameter at its bottom, spout means for transporting fluid, said spout means having a spout with a first end portion for emitting the fluid and a second end portion that is adapted for insertion into the hole of the base with the second end portion having a bottom portion, and sealing and locking means formed in the spout second end portion in its bottom portion for sealing and locking the spout to the base, said sealing and locking means including a tapered portion formed on the outer surface of the second end portion of the spout below the entrance portion of the hole, said spout tapered portion having a tapered outer diameter that decreases toward the bottom portion of the second end portion of the spout below the entrance portion of the hole, the spout being sealed and locked to the base through tight, surface-to-surface contact between the tapered inner wall surfaces and said spout tapered portion, said first end portion of the spout having uniformly thick non-tapered walls at the entrance portion of the hole when the second end portion of the spout is positioned below the entrance portion of the hole, whereby there is no groove in the spout at the entrance portion of the hole to form a weak portion of the spout at which the spout is likely to break or bend if the spout were struck by a blow.

2. The faucet of claim 1, said sealing and locking means further including a groove formed in the outer surface of the spout in the second end portion near its bottom and below said entrance portion, and an O-ring seated in the groove.

3. The faucet of claim 1, the taper of the tapered outer diameter of said tapered portion of the spout ranging from about ¾ to about 3 degrees with respect to the longitudinal axis of the spout at its second end portion

4. The faucet of claim 3, the taper of the tapered outer diameter of the spout being 1 degree.

5. The faucet of claim 1, the faucet being made of plastic or metal.

6. A faucet for transporting fluid having an inexpensive, strong and reliable construction, comprising a base having exterior surfaces and inner wall surfaces, a hole being defined by the inner wall surfaces of the base and being formed in one of the exterior surfaces and having an entrance portion and tapered inner wall surfaces, spout means for transporting fluid, said spout means having a spout with a first end portion for emitting the fluid and a second end portion that is adapted for insertion into the hole of the base with the second end portion having a bottom portion, and sealing and locking means formed in the spout second end portion in its bottom portion for sealing and locking the spout to the base, said sealing and locking means including a tapered portion formed on the outer surface of the second end portion of the spout below the entrance portion of the hole, said spout tapered portion having a tapered outer diameter that decreases toward the bottom of the second end portion of the spout below the entrance portion of the hole, the spout being sealed and locked to the base through tight, surface-to-surface contact between the tapered inner wall surfaces and said spout tapered portion, said first end portion of the spout having uniformly thick non-tapered walls at the entrance portion of the hole when the second end portion of the spout is positioned below the entrance portion of the hole, whereby there is no groove in the spout at the entrance portion of the hole to form a weak portion of the spout at which the spout is likely to break or bend if the spout were struck by a blow, said sealing and locking means further including a groove formed in the outer surface of the spout in the second end portion near its bottom, and an O-ring seated in the groove, the taper of the tapered outer diameter of said tapered portion of the spout ranging from ¾ to 3 degrees with respect tot he longitudinal axis of the spout at its second end portion, the faucet being made of metal.

7. A spout for use in a faucet, comprising a tube shaped to form a spout, a first end portion of the spout for emitting fluid, a base having an entrance portion with an entrance hole, a second end portion with a bottom portion adapted for insertion into the hole of the base through the entrance portion of the base hole, and sealing and locking means formed at the bottom portion of the second end portion of the spout for sealing and locking the spout tot he base, said sealing and locking means including a tapered portion formed on the bottom portion of the second end portion of the spout, said tapered portion of the tube having a tapered outer diameter that decreases toward the bottom of the second end portion of the spout below the entrance of the hole, said base hole having inner wall surfaces which taper inwardly the spout being sealed and locked to the base through tight, surface-to-surface contact between the tapered inner wall surfaces of the base hole and said spout tapered portion, said first end portion of the spout having uniformly thick non-tapered walls at the entrance portion of the hole when the second end portion of the spout is positioned below the entrance portion of the hole, whereby there is no groove in the spout at the entrance portion of the hole to form a weak portion of the spout at which the spout is likely to break or bend if the spout were struck by a blow.

8. The spout of claim 7, said sealing and locking means further including a groove formed in the spout in the second end portion near its bottom and below said entrance portion, and an O-ring seated in the groove.

9. The spout of claim 7, the tapered outer diameter of said taper of the tapered portion ranging from about ¾ to about 3 degrees.

10. A method of sealing and securing a spout to a base of a faucet with sealing and locking means, the base having exterior surfaces, inner wall surfaces and a lower ledge surface, a hole being defined by the inner wall surfaces and the lower ledge surface of the base and being formed in one of the exterior surfaces and having an entrance portion, said hole having a taper in its bottom portion that tapers to a smaller diameter at its bottom, the spout having a first end portion for emitting the fluid and a second end portion that is adapted for insertion into the hole of the base, and the sealing and locking means being formed in the spout second end portion in its bottom portion for sealing and locking the spout to the base, said sealing and locking means including a tapered portion formed on the outer surface of the second end portion of the spout below the entrance portion of the hole, said spout tapered portion having a tapered outer diameter that decreases toward the bottom of the second end portion of the spout, said first end portion of the spout having uniformly thick non-tapered walls at the entrance portion of the hole when the second end portion of the spout is positioned below the entrance portion of the hole, whereby there is no groove in the spout at the entrance portion of the hole to form a weak portion of the spout at which the spout is likely to break or bend if the spout were struck by a blow, said method comprising the steps of pushing the spout into the hole of the base so that the tapered portion of the spout is below the entrance portion of the hole, pushing the tapered portion of the spout into contact with the inner wall surfaces of the base, and twisting the spout slightly while pushing the spout downwardly until the second end portion of the spout tightly contacts the inner wall surfaces and lower ledge surface of the hole so that the spout is sealed and locked to the base through tight, surface-to-surface contact between the tapered inner wall surfaces and said spout tapered portion.

11. The method of claim 10, said sealing and locking means further including a groove formed in the second end portion of the spout in its bottom portion, and an O-ring seated in the grove.

said method further comprising the step of pushing the spout so that the O-ring contacts the inner wall surfaces of the hole in the base.

* * * * *